United States Patent [19]

Krippendorf

[11] Patent Number: 4,848,395

[45] Date of Patent: Jul. 18, 1989

[54] MIXING FAUCET

[75] Inventor: Manfred Krippendorf, Hemer, Fed. Rep. of Germany

[73] Assignee: Friedrich Grohe Armaturenfabrik GmbH & Co., Hemer, Fed. Rep. of Germany

[21] Appl. No.: 197,457

[22] Filed: May 23, 1988

[30] Foreign Application Priority Data

May 23, 1987 [DE] Fed. Rep. of Germany ..... 3717442

[51] Int. Cl.[4] ..... F16L 5/00

[52] U.S. Cl. ..... 137/359; 137/801; 4/192

[58] Field of Search ..... 137/607, 801, 359, 360; 4/192

[56] References Cited

U.S. PATENT DOCUMENTS

| | | | |
|---|---|---|---|
| 3,427,049 | 2/1969 | Politz | 4/192 |
| 3,443,266 | 5/1969 | Mongerson et al. | 137/359 |
| 3,807,453 | 4/1974 | Dom et al. | 137/359 |
| 4,313,469 | 2/1982 | Johnson | 137/801 |
| 4,356,574 | 11/1982 | Johnson | 137/801 |
| 4,552,171 | 11/1985 | Farrell et al. | 137/359 |

FOREIGN PATENT DOCUMENTS

| | | |
|---|---|---|
| 1653055 | 1/1963 | Fed. Rep. of Germany . |
| 2453738 | 5/1975 | Fed. Rep. of Germany . |
| 3301060 | 8/1983 | Fed. Rep. of Germany . |
| 2525296 | 10/1983 | France . |
| 2024377 | 6/1979 | United Kingdom . |

*Primary Examiner*—A. Michael Chambers
*Attorney, Agent, or Firm*—Herbert Dubno

[57] ABSTRACT

The mixing faucet for a washing and rinsing table comprises a faucet housing held on an opening in the table by a clamping means tightenable against the table underside. To improve the attachment to the washing and rinsing table, a mounting base equipped with a passage for the supply lines mountable and attachable to the opening or built on the opening in the table is provided and retaining and engaging means suitable for the mounting base are built in the faucet housing. Thereby the mixing faucet is slidable in the mounting base from the upper side of the washing and rinsing table and is lockable in an inserted position.

13 Claims, 5 Drawing Sheets

MIXING FAUCET

FIELD OF THE INVENTION

My present invention relates to a mixing faucet and its mounting on a washing and rinsing table, bidet or the like fixture support which can be formed with a throughgoing hole spanning between opposite surfaces of the support.

BACKGROUND OF THE INVENTION

A mixing faucet for a washing and rinsing table or like fixture support is known whose faucet housing is held by a clamping means tightenable against the underside of the washing and rinsing table.

In the known mixing faucet of this kind (German Utility Model No. DE-GM 16 53 055) the faucet is mounted with the help of an underlying disk and a clamping screw. The clamping screw is screwed from the underside of the washing and rinsing table into the faucet housing.

The inflow and outflow pipes or hoses are guided through an opening in the washing and rinsing table and through various openings in the disk underlying the faucet housing. By screwing the clamping screw from the underside of the washing and rinsing table into the faucet housing, the washing and rinsing table is clamped between the facing side of the faucet housing and the underlying disk whereby the mixing faucet is anchored to the washing and rinsing table.

The attachment of the mixing faucet from the wash table underside is often troublesome or annoying and commonly results in difficulties. Special tools are needed for this attachment.

OBJECT OF THE INVENTION

It is an object of my invention to provide an improved mixing faucet which does not have the above mentioned disadvantages or difficulties.

It is another object of my invention to provide an improved mixing faucet which is formed so that the attachment of the mixing faucet to the washing and rinsing table, bidet or the like can be effected from the more accessible top side.

SUMMARY OF THE INVENTION

These objects and others which will become more readily apparent hereinafter are attained in accordance with my invention in a mixing faucet for a washing and rinsing table and/or other fixture support having a throughgoing hole between a top surface and an underside of the support, the faucet comprising a faucet housing held by a clamping means tightenable against the underside of the washing and rinsing table.

According to my invention a mounting base with a passage for a plurality of supply lines is attachable to and inserted in the washing and rinsing table through the opening or hole in the washing and rinsing table or is mounted on the upper surface around or on this hole, and retaining and engaging means are provided on the faucet housing suitable for engagement by the mounting base so that the mixing faucet can be pushed into the mounting base from the upper side of the washing and rinsing table and can be locked in an inserted position.

By "fixture support" I mean any structure having a hole as described and an exposed surface on which a faucet can be mounted. Generally this implies an at least locally substantially planar surface on which the fixture sits. This includes of course a washing and rinsing table, bidet or the like. In this text when I refer to the washing and rinsing table and especially in the claims appended below I can mean any such fixture support.

There are several alternative embodiments of my invention. In one embodiment the mounting base can comprise a stepped sleeve whose one portion of a larger diameter is mounted with a facing side on the upper side of the washing and rinsing table or bidet and whose other portion of a smaller diameter is inserted in the opening provided in the washing and rinsing table.

At least one radially spreadable clamping piece on the other portion of smaller diameter is mounted and clamped on the washing and rinsing table, while attachment means for the faucet housing are positioned on the portion of a larger diameter. The portion of the stepped sleeve having the larger diameter can be provided for connection with the housing. The housing receives with a blind hole the larger portion of the stepped sleeve.

A locking pin or a setscrew can be provided in the housing in the vicinity of a wall of the blind hole so that the housing is secured in the inserted position in the stepped sleeve.

The stepped sleeve can have two opposing interiorly protruding enlargements in the vicinity of a diameter of the sleeve in each of which a clamping screw protruding on the facing side is arranged parallel to the central axis of the sleeve in a screw hole.

A lug can be held with screwthreads on the protruding end of the clamping screw in such a way that on insertion of the stepped sleeve in the opening the lugs are adjustable inwardly toward the central axis and are pivotable toward the exterior for clamping and in this outwardly pivoted position the stepped sleeve is clamped with the aid of the clamping screw in the opening.

Alternatively the stepped sleeve can be formed by a connector pipe and a disk which are coupled together with a sleeve thread, a plurality of diametrically opposing slots being provided in a wall of the connector pipe in which a plurality of corner wedge pieces are engageable depending on the thickness of the washing and rinsing table or bidet, which fasten with a lateral member radially through the slot and together with the sleeve thread and the disk effect a clamping action.

In another embodiment the stepped sleeve can have two opposing slit cavities on the other portion of the smaller diameter parallel to the central axis of the sleeve and a clamping screw is held in a screw hole in the portion of the sleeve of larger diameter held protruding centrally into each of the slit cavities and is engaged with a slider piece mounted slidably in one of the slit cavities by a screwthread.

A corner lug is mounted with the help of a rubber cord ring or a spring tightly in a spread position and is held with an elongated hole by a clamping screw so that the insertion and clamping of the stepped sleeve is constructed like a socket insert for a concealed electrical socket. The stepped sleeve can be made from plastic material.

Means for connecting a plurality of the supply lines to the mounting base are constructed so that the supply lines can be tightly connected to the mounting base and at the same time with the housing on insertion in the mounting base.

An insert mounted in the mounting base from the upper side of the washing and rinsing table or the bidet can be provided in which the supply lines are held. The means for connecting the supply lines are adjustable in such a way that the connection for the supply lines can be made to mixing faucets with different spacing dimensions.

A disk mounted on the upper side of the washing and rinsing table or bidet can be provided as a mounting base on which are formed the attachment means to the washing and rinsing table and the retaining means for the mixing faucet.

An advantage attained with my invention is that the mixing faucet can be guided through the passage or opening in the washing and rinsing table or bidet from the upper side of the washing and rinsing table or bidet and can be attached there in a simple way by the mounting base according to my invention. The attachment of the mixing faucet to the mounting base can be provided advantageously by a bayonet coupling or slide lock. However a comparatively simply operable attachment can be made with a lock nut-bolt attachment between the mounting base and the mixing faucet. The mounting base can be made in one piece with the washing and rinsing table or bidet or alternatively they can be made as separate parts joined subsequently.

In a washing and rinsing table made from ceramic material, by contrast, the mounting base can be formed as a separate piece.

The mounting base according to my invention is formed so that it can be put in the opening of the wash table from the upper side of the table and clamped there.

Thus the mounting base can advantageously be formed as a stepped sleeve which is inserted with its slender sleeve portion in the opening of the washing and rinsing table and thus the facing surface of the stepped enlarged portion of the sleeve rests on the upper wash table surface. Clamping means are provided on the stepped sleeve with which the sleeve is attached to the washing and rinsing table from its upper side.

On the other hand the mounting base can also be formed as a relatively flat disk which is mounted on the washing and rinsing table in the vicinity of the opening in its upper side and which carries the clamping means fastening below the table and the attachment means for the mixing faucet. This structure can be used appropriately with parts made of comparatively thin material such as sheet metal.

To reduce the spatial requirements for the mount in a mixing faucet in which the supply lines are not manufactured as soldered to the faucet housing, the mixing faucet can be combined in a faucet housing in installation with a socket coupling. The mounting base appropriately can be provided with holding means for the supply lines which are such that on mounting of the mixing faucet a tight connection is made to the connector pipes.

In one embodiment of the invention the mounting of the supply lines can be effected by a disk or insert mounted on the mounting base from the top side of the wash table in which these tubes or pipes are held. Here too, the mounting of the supply lines can be made adjustable so that mixing faucets with different spacing dimension can be used and the connection for the supply lines can be made.

In additional forms of my invention the clamping means for the mounting base can make use of pivotable lugs which after insertion in the opening by an assembler manually through the passage for the supply lines of the mixing faucet and for the operating rod for the separate valves are pivoted into a spread position and then from the top or upper side are pressed with clamping screws guided in the sleeve outer casing against the underside of the table. Alternatively longitudinal slit cavities guided parallel to the central axis, e.g. with clamping lugs tightenable in a spread position in rubber cord rings, can be provided in the same way as they are known for the aforementioned socket inserts in electrical installations.

Finally the stepped sleeve can be formed in two parts such that both parts are screwed together by sleeve threads. The portion introducable in the opening of the table can be formed as a connector pipe and has several diametrically opposed slots in which suitably dimensioned corner wedge pieces are inserted from the top side of the table so that after that with the help of the sleeve thread both sleeve parts can be secured to the wash table. Stepped slots positioned over each other act to adjust to different thicknesses of the wash table.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
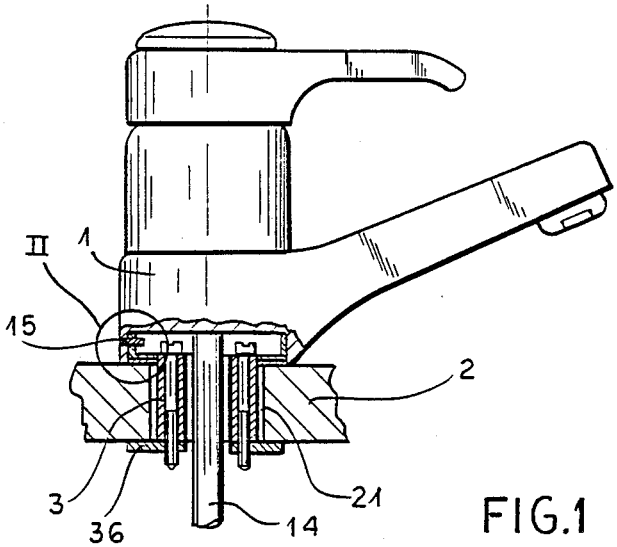
FIG. 1 is a partial cross sectional view of a mixing faucet mounted on a washing and rinsing table according to my invention.

In the examples shown in the drawing the same or corresponding elements are provided with the same reference character for the sake of a simpler presentation.

A mixing faucet with a faucet housing 1 is shown in the drawing.

On the lower side of the housing 1 a blind hole 12 is formed in which the larger diameter portion 32, 321 of the stepped sleeve 3 is inserted. The housing 1 can be attached with a slide lock or bayonet coupling 11 to the projecting portion 32 of the stepped sleeve 3 and secured with the aid of a locking pin 15 or a setscrew 13 in the mounted position.

The supply line 14 for the mixing faucet and the eventually required operating rod for valves locate separately under the washing and rinsing table 2 are inserted through a passage 31 in the stepped sleeve 3 under a washing and rinsing table 2.

Figure 3:
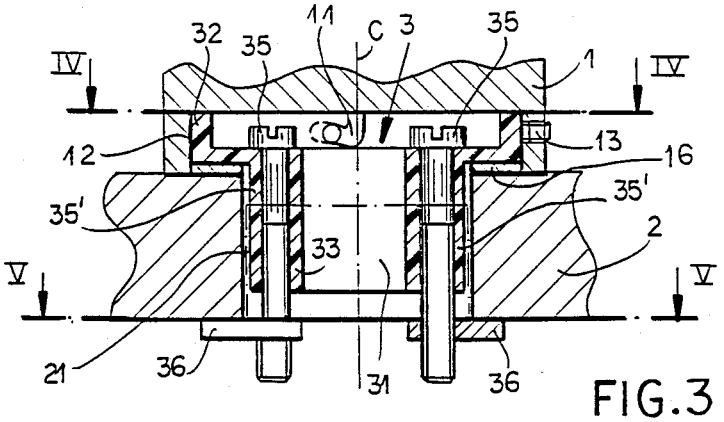
FIG. 3 is a enlarged longitudinal cross sectional view of an attachment device for the stepped sleeve.
Figure 4:
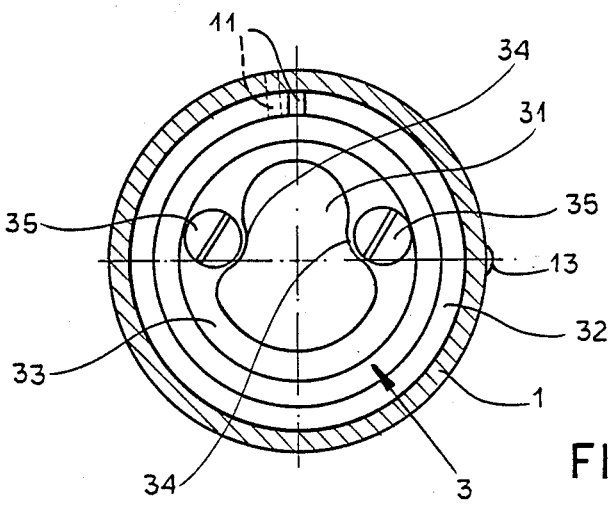
FIG. 4 is a transverse cross sectional view of the attachment device shown in FIG. 3 taken along the section line IV—IV thereof.
Figure 5:
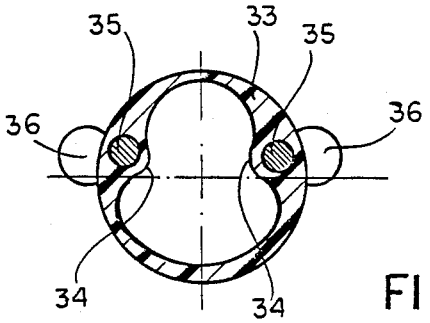
FIG. 5 is a cross sectional view of the attachment device shown in FIG. 3 taken along the section line V—V thereof.
Figure 6:
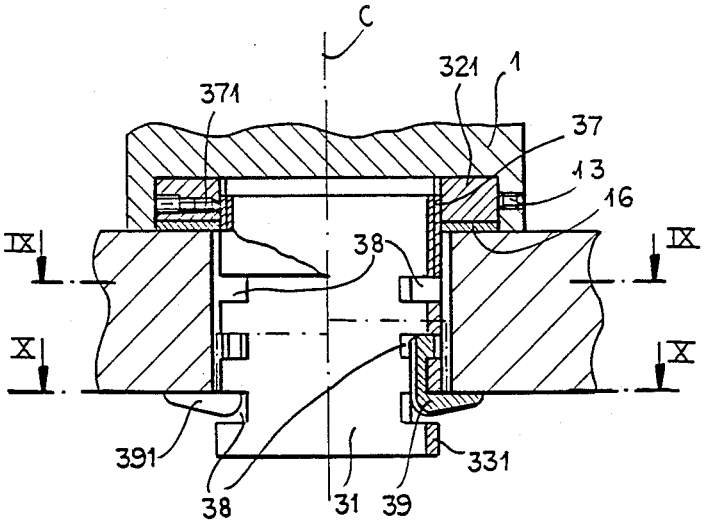
FIG. 6 is a longitudinal cross sectional view through another attachment device for the mixing faucet of FIG. 1.
Figure 7:
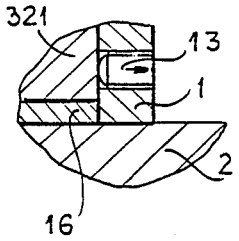
FIG. 7 is a enlarged cross sectional view of a part of the attachment device shown in FIG. 6.
Figure 8:
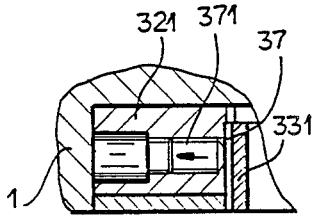
FIG. 8 is a enlarged cross sectional view of another part of the attachment device according to FIG. 6.
Figure 9:
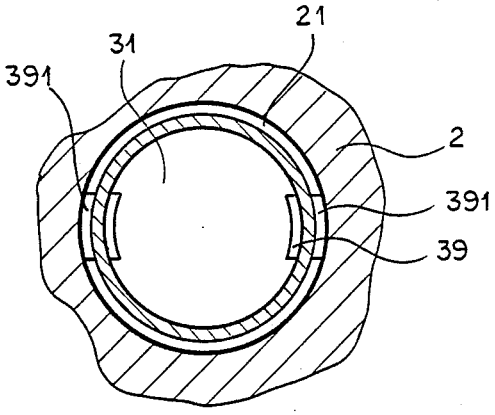
FIG. 9 is a cross sectional view of the attachment device according to FIG. 6 taken along the section line IX—IX thereof.
Figure 10:
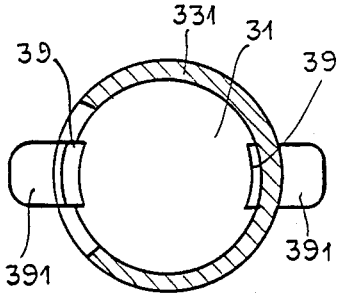
FIG. 10 is a cross sectional view of the attachment device according to FIG. 6 taken along the section line X—X thereof.

The stepped sleeve 3, as is shown especially in FIGS. 3 to 5, has a portion 33 which is smaller in diameter which is dimensioned so that it is inserted in a opening 21 of the washing and rinsing table 2 about which a seal 16 on the facing side of the discontinuous stepped larger portion can be laid. The stepped sleeve 3 has two diametrically opposed enlargements 34 in the vicinity cf the passage 31.

A clamping screw 35 is located in each enlargement 34 protruding into a screw hole 35' parallel to the central axis c of the sleeve and is attached by a screwthread with a lug 36.

In the installation of the mixing faucet, the stepped sleeve 3 is pushed with the smaller portion 33 into the opening 21 in the washing and rinsing table with the lugs 36 swung to the central axis c.

Now both lugs can be grasped manually through the passage 31 in the stepped sleeve 3 and can be rotated into the outer position. After that the stepped sleeve 3 can be rigidly clamped with the aid of the clamping screws 35 with a screwdriver with the help of the clamping screws 35.

Then the mixing faucet with supply lines 14 etc. can be guided through passage 31 and put with the blind hole 12 on the portion 32 of larger diameter and attached with the aid of the slide lock or bayonet coupling 11.

Then the locking pin 15 (FIGS. 1, 2) or the setscrew 13 (FIG. 3) can be inserted for securing the mounted position. Thus the mixing faucet is mounted on the washing and rinsing table 2 and the supply lines 14 can then be connected with the wash supply line system. The disassembly of the mixing faucet is effected in reverse sequence. If the present mixing faucet is to be only exchanged for or replaced by a new one, the stepped sleeve 3 can remain mounted on the washing and rinsing table.

Figure 2:
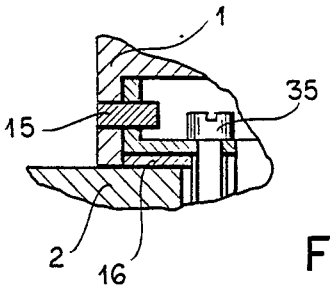
FIG. 2 is a enlarged cross sectional view of a portion of the mixing faucet shown in FIG. 1.

In FIGS. 6 to 10 another embodiment of the clamping means for the mixing faucet according to FIG. 1 is shown. The stepped sleeve 3 is formed from a connector pipe 331 and a disk 321. Both parts are attached with each other by a sleeve thread 37. A row of opposing slots 38 are formed in the connector pipe 331 with spacing from each other. The corner pieces 39 are inserted and engageable in these slots 38 as can be seen from FIGS. 6, 9 and 10.

The attachment of the housing 1 on the disk 321 is effected in the same way as in the previously described embodiment. The assembly with the previously described clamping means can be effected in the following manner: First the connector pipe 331 is sunk in the surface of the washing and rinsing table 2 until there is contact between the disk 321 and the seal 16.

Then the corner wedge pieces 39 are inserted in the corresponding slots 38 through the passage 31 from the top side of the washing and rinsing table 2 so that the corner wedge pieces 39 are fastened with lateral members 391 below the underside of the washing and rinsing table 2.

Now the disk 321 on the connector pipe 331 is rotated until the washing and rinsing table is sufficiently clamped between the lateral members 391 and the disk 321.

After that the rotational position of the connector pipe 331 on the disk 321 is secured with a securing screw 371 which is inserted radially in the disk 321.

Finally the mixing faucet with the supply pipe or hose 14 can be guided through the stepped sleeve 3 and the disk 321 sunk in the blind hole 12 of the housing 1 and attached with the help of the slide lock.

To secure the mixing faucet in the assembled position then the setscrew 13 is rotated whereby the mixing faucet is mounted on the washing and rinsing table.

An embodiment modified from that shown in FIGS. 3 to 5 is shown in FIGS. 11 to 15. The stepped sleeve 3 has flattened portions 381' adjacent the passage 31 instead of the enlargements projecting into the passage 31 as can be seen particularly from FIGS. 12 and 13.

On the outer surface of the portion 33 of the stepped sleeve having the smaller diameter are formed slit cavities 381 parallel both to the central axis and to the flattened portions 381'. In both opposing slit cavities 381, a clamping screw 35 is projecting from the larger portion 32 parallel to the central axis c which is screwed in an axially slidable slider piece 361 shown in FIG. 15 axially slidable in one of the slit cavities 381 with screwthreads 351.

Figure 14A:
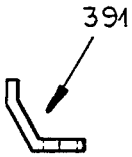
FIG. 14*a*, 14*b* and 14*c* are top, front and side views respectively, of a clamping lug used in the attachment device shown in FIG. 11.
Figure 14B:
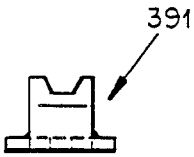
Figure 14C:
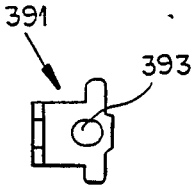
Figure 15A:
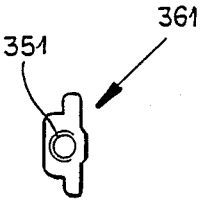
FIG. 15*a* and 15*b* are side and top views, respectively, of a sliding piece as shown in FIG. 11.
Figure 15B:
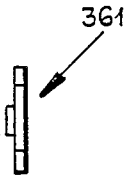

A corner wedge piece 391 shown in detail in FIG. 14 is mounted above on the slider piece 361 and is held with the help of an elongated hole 393. The corner piece 391 is thus tightened with the help of contractible rubber ring 392 in the spread position.

Figure 11:
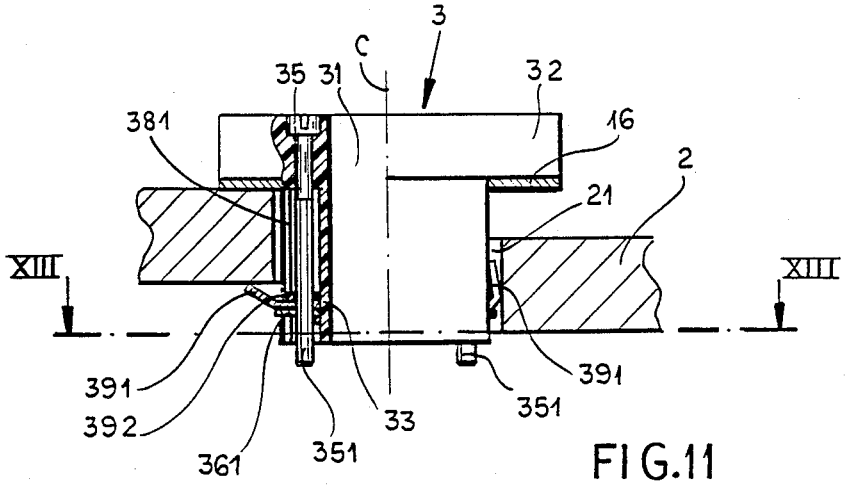
FIG. 11 is a partial longitudinal cross sectional view through an additional attachment device for a mixing faucet according to FIG. 1 in which the left half of the FIGURE shows the stepped sleeve clamped on the washing and rinsing table, while the insertion process in the opening in the washing and rinsing table is shown in the right half.
Figure 12:
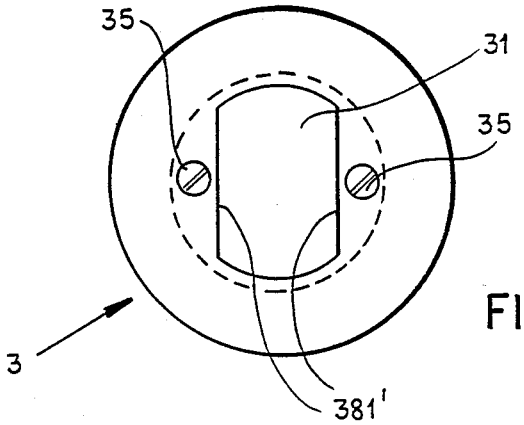
FIG. 12 is a top plan view of the attachment device according to FIG. 11.
Figure 13:
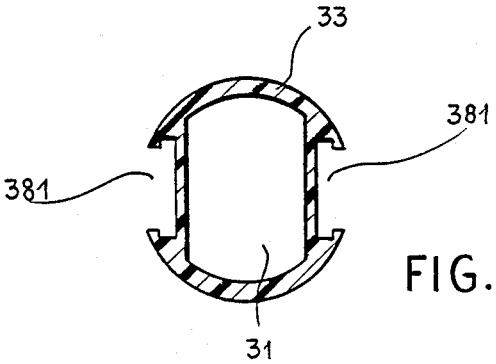
FIG. 13 is a cross sectional view through the attachment device according to FIG. 11 taken along the section line XIII—XIII thereof.

In the insertion process of the stepped sleeve 3 in the opening 21 of the washing and rinsing table 2 both opposing corner wedge pieces 391 are folded in the associated slit cavities 381 as is indicated particularly in the right half of FIG. 11.

As soon as the corner wedge pieces 391 are brought out from the opening 21, they are folded into the spread position by the contractible rubber ring or spring 392 so that then the stepped sleeve 3 with the help of the clamping screws 35 can be clamped to the washing and rinsing table 2. The assembly process is effected in the same way as in the other embodiments described previously.

Particularly in the embodiment according to FIGS. 3 to 11, the stepped sleeve can be made economically from plastic in an injection molding process. Also instead of a slide lock or bayonet coupling between the stepped sleeve 3 or the mounting base, a lock nut screw or the like attachment may be provided with which the faucet housing can be reliably secured on the mounting base.

Figure 16:
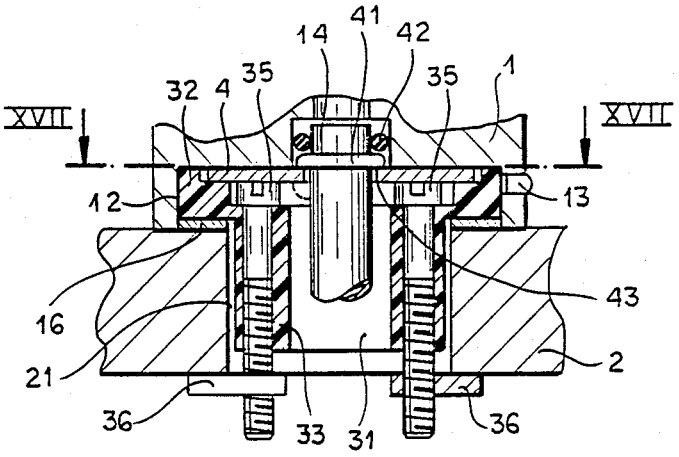
FIG. 16 is a longitudinal cross sectional view of an attachment device with a mixing faucet according to FIG. 3 in which the mixing faucet is provided with supply lines inserted in the faucet housing.
Figure 17:
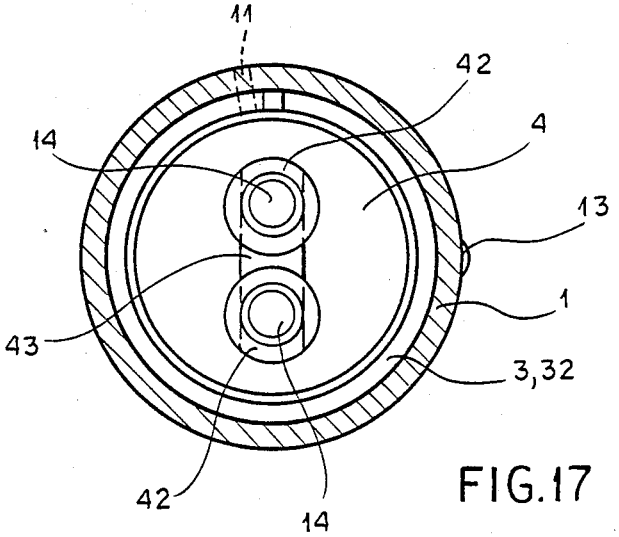
FIG. 17 is a cross sectional view through the mixing faucet according to FIG. 16 taken along the section line XVII—XVII.

An additional embodiment is shown in FIGS. 16 and 17. The assembly of the stepped sleeve 3 in the washing and rinsing table 2 is effected in the same way as in the embodiment shown in FIG. 4. The supply lines 14 in this mixing faucet are not made as in a factory assembly process attached rigidly with the housing but are attached during installation by plug connection with the mixing faucet. Thus a disk-like insert 4 is mounted on the stepped sleeve from the facing side of the larger portion 32. The supply lines 14 are thus held axially fixed with a ring like bulged portion 41 in a slot 43 of the insert 4.

After assembly of the stepped sleeve 3 on the washing and rinsing table 2, the insert 4 thus can be put in and held with the supply lines in the portion 32 of the stepped sleeve 3. On mounting the mixing faucet on the portion 32 then simultaneously the supply lines 14 with their protruding ends are inserted in correspondingly formed openings in the faucet housing and with one or more round contractible sealing rings 42. The securing of the mixing faucet in the socket position can be effected as in the previously described embodiments.

Instead of the slot 43 with which a fit to the different connector spacing of different mixing faucets is possible, different openings for receiving the supply lines 14 in the insert 4 can be provided. Also the supply lines 14 can be attached directly to the stepped sleeve so that a special insert can be omitted.

By definition the "retaining and engaging means" are the means by which the faucet housing engages and holds the mounting base. On the other hand by "attachment means" I mean the means for attaching the mounting base to the faucet housing which are on the mounting base. The "retaining or engaging means" include the lock pin or screw and the blind hole. The "attachment means" includes the bayonet coupling or slide lock 11.

By "clamping piece" in the following I mean either the lug 36 or the corner piece 391 which are used to secure the mounting piece to the washing and rinsing table 2, i.e. to the fixture support.

By "means for mounting the supply lines" I mean the parts necessary to attach and hold the supply lines including the insert 4.

I claim:

1. In a mixing faucet for a fixture support comprising a faucet housing held by a clamping means tightenable against an underside of said fixture support, the improvement wherein a mounting base with a passage for a plurality of supply lines is attached to and inserted in an opening of said fixture support, retaining and attaching means are provided on said faucet housing so that said mixing faucet can be pushed into said mounting base from an upper side of said fixture support and can be locked in an inserted position, and wherein said mounting base comprises a stepped sleeve whose one portion of a larger diameter is mounted with a facing side on said upper side of said fixture support and whose other portion of a smaller diameter is inserted in said opening, at least one radially spreadable clamping piece for clamping onto said fixture support being provided on said other portion of smaller diameter, while attachment means for said faucet housing are located on said one portion of a larger diameter.

2. The improvement defined in claim 1 wherein said portion of said stepped sleeve having said larger diameter is provided with a slide lock or bayonet coupling for connection with said faucet housing, said faucet housing receiving with a blind hole said one portion of said stepped sleeve protruding therein.

3. The improvement defined in claim 1 wherein a locking pin or a setscrew is provided in said housing in the vicinity of a wall of said opening so that said housing is secured in said inserted position in said stepped sleeve.

4. The improvement defined in claim 1 wherein said stepped sleeve has two opposing interiorly protruding enlargements in the vicinity of a diameter of said sleeve in each of which a clamping screw protruding on the facing side is arranged in a screw hole parallel to a central axis of said opening, a lug being held with screwthreads on a protruding end of said clamping screw in such a way that on insertion of said stepped sleeve in said opening said lugs are adjustable inwardly toward said central axis and are pivotable toward the exterior for clamping and in an outwardly pivoted position said stepped sleeve is clamped with the help of said clamping screw in said opening.

5. The mixing faucet defined in claim 1 wherein said stepped sleeve is formed by a connector pipe and a disk which are coupled together with a sleeve thread, a plurality of diametrically opposing slots being provided in a wall of said connector pipe in which a plurality of corner wedge pieces are engageable depending on the thickness of said fixture support, which fasten with a lateral member radially through said slot and together with said sleeve thread and said disk cause a clamping.

6. The improvement defined in claim 1 wherein said stepped sleeve has two opposing slit cavities on said other portion of said smaller diameter parallel to a central axis of said stepped sleeve and a clamping screw is held in a screw hole in said one portion of said sleeve of said larger diameter protruding centrally into each of said slit cavities and is combined with a slider piece mounted slidably in one of said slit cavities by a screwthread, a corner lug is mounted with the help of a contractible rubber ring or a spring tightenable in a spread position and is held in an elongated hole by said clamping screw so that the insertion and clamping of said stepped sleeve is constructed like a socket insert for a concealed electrical socket.

7. The improvement defined in claim 1 wherein said stepped sleeve is made from plastic material.

8. The improvement defined in claim 1 wherein means for connection of a plurality of said supply lines on said mounting base are constructed so that said supply lines are tightly connected to said mounting base and at the same time with said housing on insertion of said mixing faucet in said mounting base.

9. The improvement defined in claim 8 wherein an insert mounted in said mounting base from said upper side of said fixture support is provided in which said supply lines are held.

10. The improvement defined in claim 8 wherein said means for connection of said supply lines are adjustable in such a way that said connection of said supply lines can be made to any of a number of said mixing faucets with different spacing dimensions.

11. The improvement defined in claim 1 wherein a disk mounted on the upper side of said fixture support is provided as said mounting base on which are formed said clamping means and said retaining and engaging means for said mixing faucet.

12. A mixing faucet for a fixture support having an opening for a plurality of supply lines for said mixing faucet comprising:

as faucet housing with a blind hole on an underside facing said fixture support;

a stepped sleeve provided with a passage for said supply lines attached to and inserted in said opening whose one portion of a larger diameter is mounted with a facing side on an upper side of said fixture support and whose other portion of a smaller diameter is inserted in said opening, said faucet housing receiving said one portion of said stepped sleeve in said blind hole, said stepped sleeve having two opposing interiorly protruding enlargements in a vicinity of a diameter of said sleeve in each of which a clamping screw protruding from the facing side is arranged parallel to a central axis of said stepped sleeve in a screw hole, a lug being held with screwthreads on a protruding end of said clamping screw in such a way that on insertion of said stepped sleeve in said opening said lugs are movable inwardly toward said central axis and are pivotable toward the exterior for clamping and in an outwardly pivoted position said stepped sleeve is clamped with the help of said clamping screw in said opening;

a slide lock or bayonet coupling for connection of said faucet housing with said stepped sleeve provided on said portion of said stepped sleeve having said larger diameter so that said mixing faucet can be pushed into said stepped sleeve from the upper side of said fixture support and is engageable in an inserted position; and a locking pin or a setscrew in said faucet housing in a vicinity of a wall of said blind hole so that said housing is secured in said inserted position in said stepped sleeve.

13. A mixing faucet for a fixture support having an opening for a plurality of supply lines for said mixing faucet comprising:

a faucet housing with a blind hole on an underside facing said fixture support;

a stepped sleeve provided with a passage for said supply lines attached to and inserted in said opening whose one portion of a larger diameter is mounted with a facing side on an upper side of said fixture support and whose other portion of a smaller diameter is inserted in said opening, said faucet housing receiving said one portion of said stepped sleeve in said blind hole, said stepped sleeve comprising a connector pipe and a disk which are coupled together with a sleeve thread, a plurality of diametrically opposing slots being provided in a wall of said connector pipe in which a plurality of corner wedge pieces are engageable depending on the thickness of said fixture support, each of which fasten with a lateral member radially through one of said slots and together with said sleeve thread and said disk cause a clamping; and a locking pin or a setscrew in said faucet housing in the vicinity of a wall of said blind hole so that said housing is secured in said inserted position in said stepped sleeve.

* * * * *